US006189153B1

(12) United States Patent
Diamond

(10) Patent No.: US 6,189,153 B1
(45) **Date of Patent: *Feb. 20, 2001**

(54) POCKET LINING

(76) Inventor: Margaret Elizabeth Diamond, 20 Loch Laidon Street, Sandyhills, Glasgow (GB), G32 9JP ( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/117,073

(22) PCT Filed: Jan. 25, 1996

(86) PCT No.: PCT/GB96/00153

§ 371 Date: Jul. 23, 1998

§ 102(e) Date: Jul. 23, 1998

(87) PCT Pub. No.: WO96/22707

PCT Pub. Date: Aug. 1, 1996

(30) Foreign Application Priority Data

Jan. 25, 1995 (GB) ..... 9501474
Aug. 11, 1995 (GB) ..... 9516481

(51) Int. Cl.[7] ..... A41D 27/20
(52) U.S. Cl. ..... 2/247; 2/248; 2/249

(58) Field of Search ..... 2/247, 248, 249, 2/250, 251, 252, 253, 254, 255

(56) References Cited

U.S. PATENT DOCUMENTS

| | | | | |
|---|---|---|---|---|
| 3,723,994 | * | 4/1973 | Tucker | 2/248 |
| 3,777,313 | * | 12/1973 | Bergsten et al. | 2/247 |
| 4,139,914 | * | 2/1979 | Tarr | 2/247 |
| 5,124,190 | * | 6/1992 | Isoe et al. | 2/247 |
| 5,165,115 | * | 11/1992 | Stanislaw | 2/247 |
| 5,421,032 | * | 6/1995 | Murphy | 2/247 |

* cited by examiner

*Primary Examiner*—John J. Calvert
*Assistant Examiner*—Gary L. Welch
(74) *Attorney, Agent, or Firm*—Gifford, Krass, Groh, Sprinkle, Anderson & Citkowski, P.C.

(57) ABSTRACT

The invention relates to a pocket liner comprising a pouch dimensioned to fit within a pocket constituting an integral part of an article, the pouch being formed of a material which is flexible and resistant to abrasion and perforation and may be provided with attachment means which may comprise clasps or belt loops or stiffening means in the vicinity of the pouch opening. The pocket liner is detachable and affords protection to a pocket from heavy usage and sharp edged objects, for example pipes (tobacco), heavy keys and golf tees, etc.

15 Claims, 4 Drawing Sheets

Figure 1A:
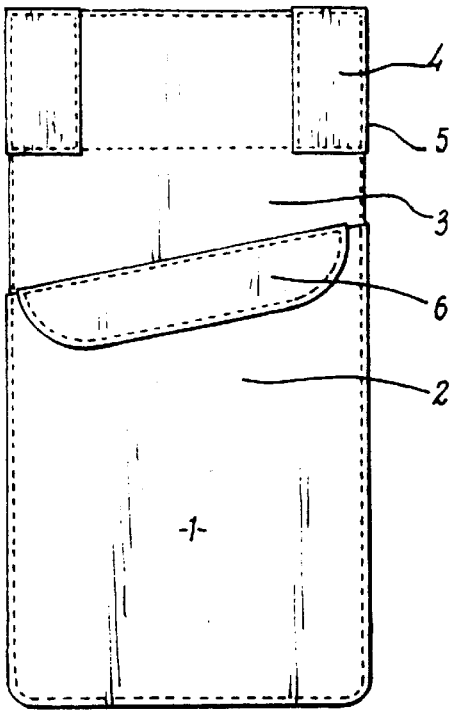

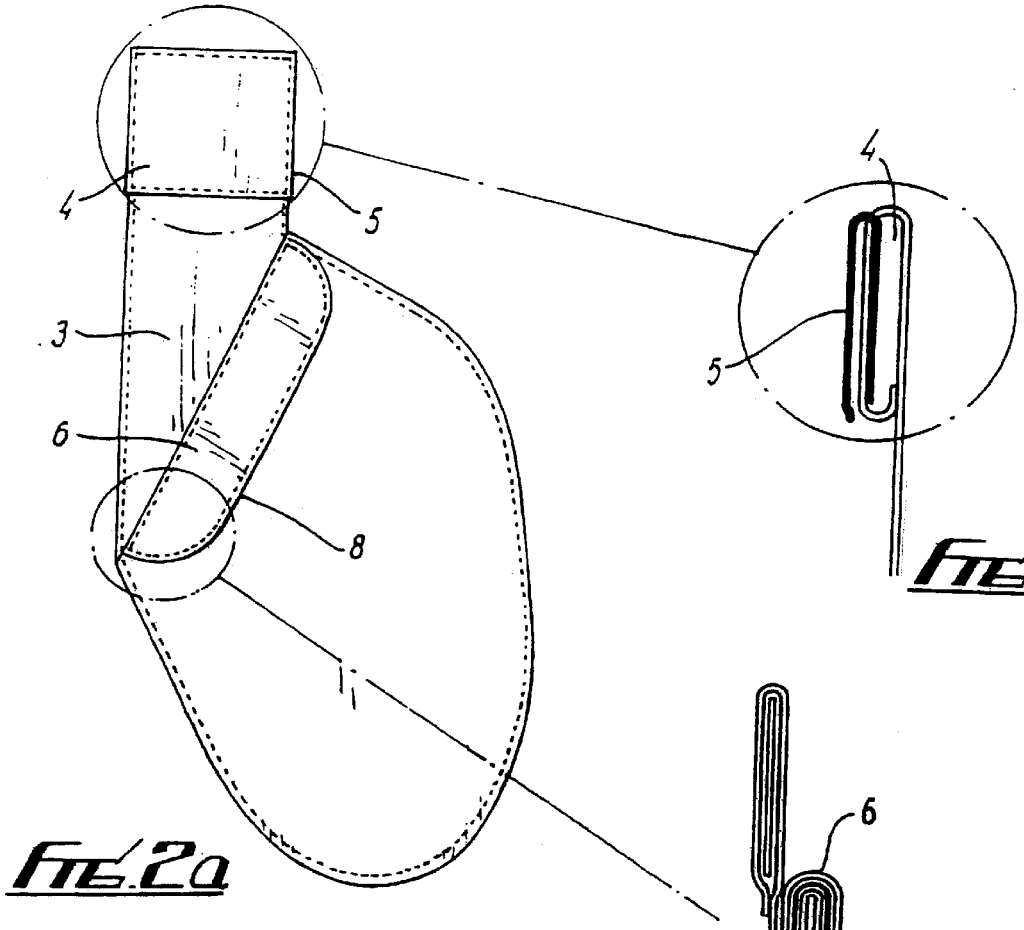
FIG. 2a
FIG. 2d
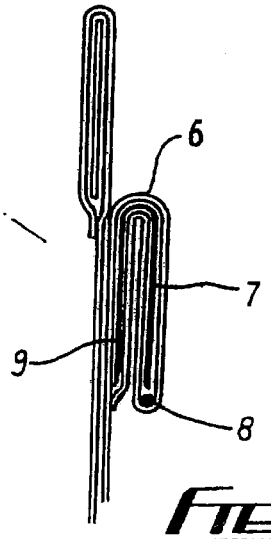
FIG. 2b
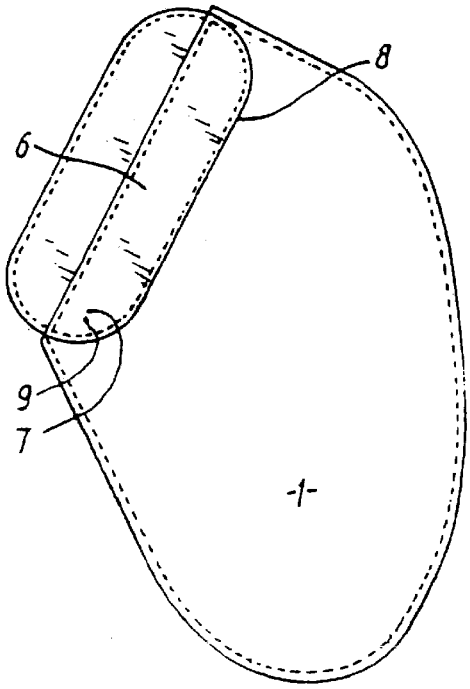
FIG. 2c

POCKET LINING

This invention relates to pockets and in particular relates to a protective lining for pockets which is resistant to abrasion and perforation.

Pockets of garments and other items are frequently damaged by golf tees, keys, smokers' pipes, hand tools, coins, etc. Replacement pocket linings are available which can be placed or inserted "over" a worn pocket lining. The replacement pocket lining is then sewn or stitched over and onto the existing pocket lining to provide a second layer of pocket lining.

But this has the disadvantage that the pocket lining of the replacement pocket is of a similar material to a standard pocket lining and it is not sufficiently robust to afford better protection to heavy usage and sharp edged objects, for example pipes (tobacco), heavy keys and golf tees, etc.

Also, attaching the pocket lining requires sewing skills, the two layers allow objects to get trapped between them and attachment of the lining could weaken the pocket at the sewn connection to the existing pocket lining.

It is an object of the present invention to provide a replacement pocket which is not sewn directly to an article, and which can afford protection to the original pocket and the article generally.

According to the present invention there is provided a pocket lining comprising a pouch dimensioned to fit within a pocket constituting an integral part of an article, the pouch being formed of a material which is flexible and resistant to abrasion and perforation.

The pocket lining may be formed of leather or another suitable material, such as nylon or of a mixture of such materials.

In one embodiment the article may be an article of clothing.

Alternatively the article may be a bag for example a handbag, a golf bag or a sports bag.

The pocket lining is preferably provided with attachment means for attachment to a part of the article outside the pocket, and the pocket lining is preferably devoid of attachment directly to the interior of the pocket.

The attachment means may be a clasp, one or more belt loops, and/or other suitable means by which the pocket lining may be detachable secured to the article.

The attachment means is preferably a front flap and an extension portion respectively provided on opposing walls of the pocket lining whereby when the pocket lining is fitted within a garment the front flap folds over the outer wall of the pocket and the extension portion extends out of the pocket.

In one embodiment the extension portion may comprise at least one belt loop.

The pocket lining is preferably provided with stiffening means in the vicinity of the pouch opening. The stiffening means is preferably a portion of plastic or other suitable material and may be fitted to either the front flap or the extension portion, or both.

Preferably the stiffening means is fitted into the extension portion and extends beyond the opening of the pocket.

The pocket lining may be fitted to an article (e.g. jacket, coat, trousers, bags, etc) without sewing, to protect against damage by (for example) golf tees, heavy keys, smokers' pipes, hand tools, etc.

The present invention will now be further described with reference to the accompanying figures in which:

FIGS. 1*a–d* illustrate various embodiments of a pocket according to the present invention.

FIGS. 2*a* and *b* illustrates a right hand trouser pocket with FIG. 2*b* detailing the pocket protector fold.

FIG. 2*d* shows a detail of the belt loop of the trouser pocket.

FIG. 2*c* illustrates an alternative embodiment of the pocket of FIG. 2*a*.

FIGS. 3*a–e* illustrate details of a pocket according to the present invention which may be used by a golfer.

As can be seen in the figures, the pocket lining (1) is a detachable pocket of various styles to suit various styles of trouser, jacket, skirt or coat pocket. Also, it can be used in pieces of baggage, such as handbags, sports bags and golf bags.

A pocket according to the present invention would be made of a robust material and it may be a one piece or made up with two or more pieces of materials sewn or fastened together.

The pocket lining (1) can be dimensioned to fit within an existing pocket of a garment or an article such as a handbag, sports bag, or golf bag.

As shown in FIGS. 1*a–d*, the pocket lining consists of two pieces of material (2, 3) which are sewn together to form the pocket lining.

In FIG. 1*a*, one piece of the pocket lining (3) extends up and is formed such that it comprises a belt loop (4) such that a belt may be threaded through it.

The pocket liner (1) as shown in FIG. 1*a* can further or alternatively comprise a flexible clasp (5) fixed inside or outside the material of the pocket protector enabling it to be attached at the waist band of a garment.

The pocket lining (1) as shown in FIG. 1*a* may be further secured in a pocket by the provision of the front flap (6) of the liner which can be folded over the existing pocket opening.

Figure 1B:
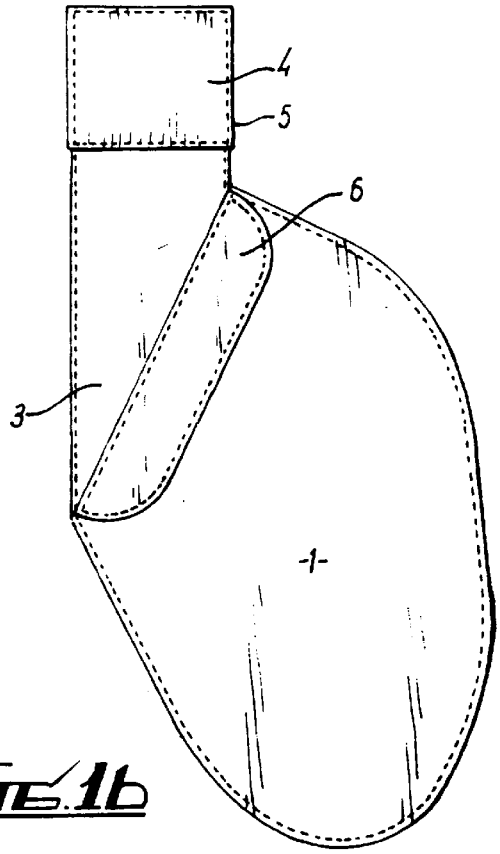
Figure 1C:
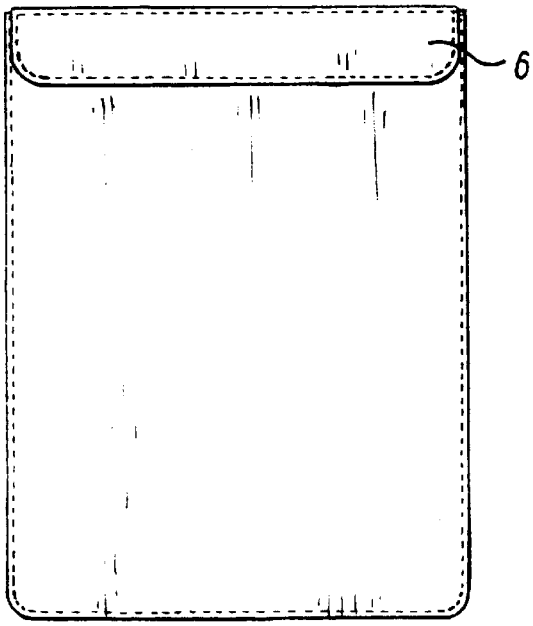
Figure 1D:
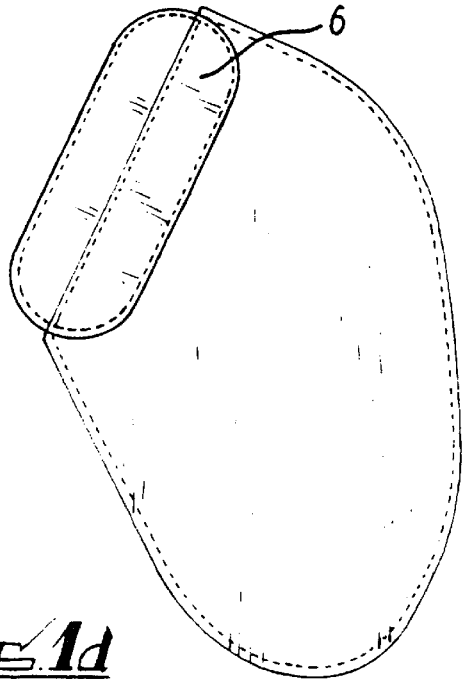
Figure 3F:
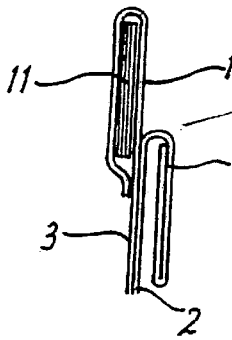
Figure 3A:
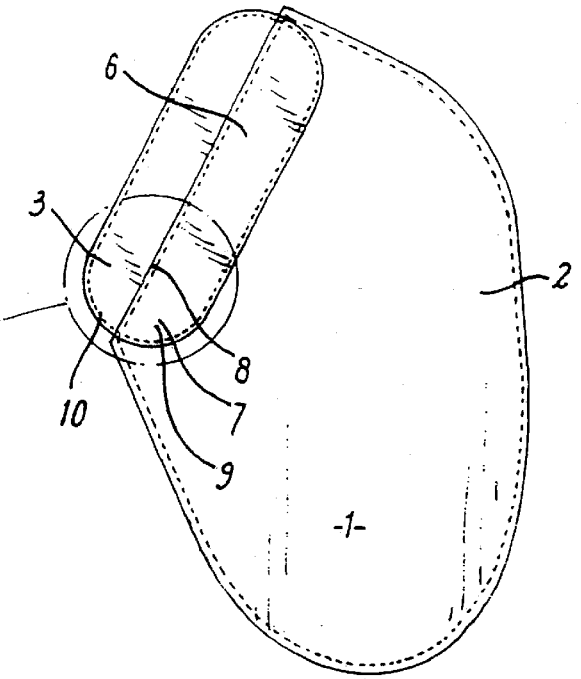
Figure 3B:
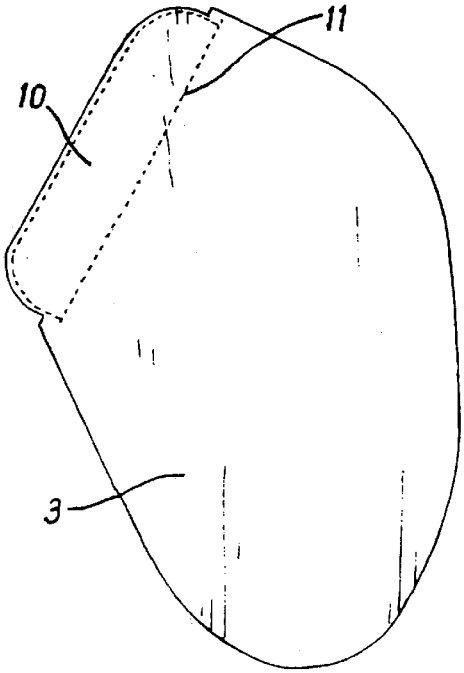
Figure 3C:
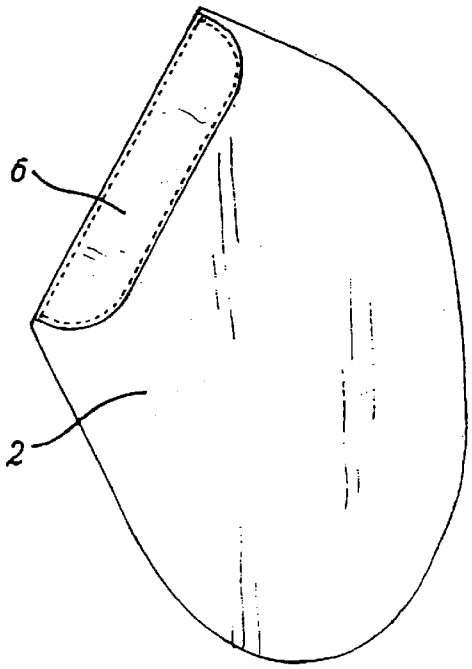
Figure 3D:
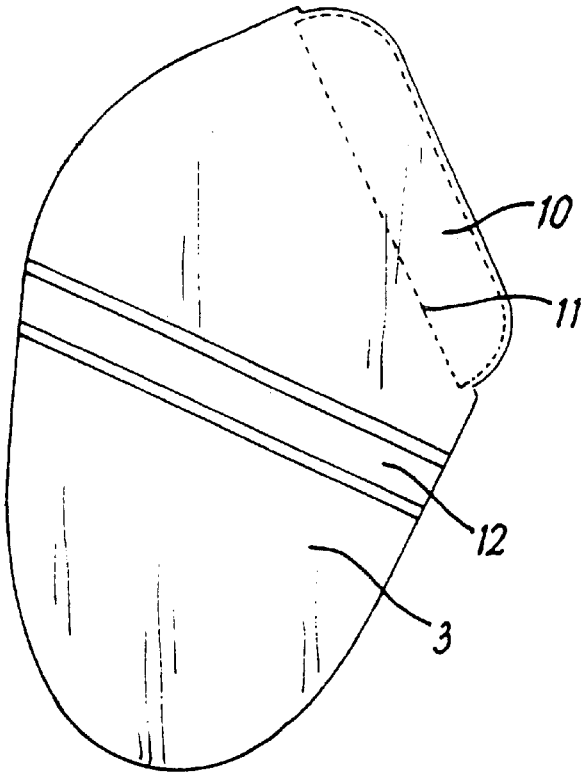
Figure 3E:
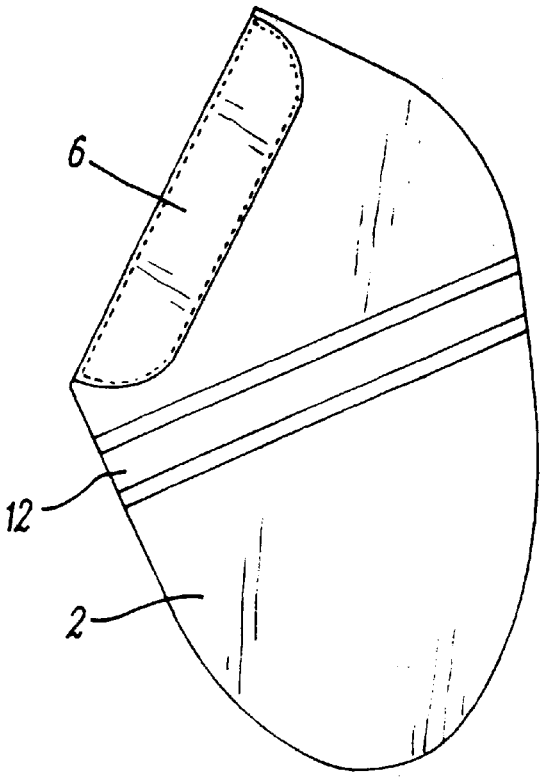

In FIG. 1*b* the pocket lining (1) is of an alternative shape to that shown in FIG. 1*a* and is dimensioned to fit inside a conventional trouser pocket.

Again the pocket lining extends at the back portion (3) to form a belt loop (4) such that it can be held by a belt on a garment, or a flexible clasp (5) on the lining attaches to the waistband of a garment.

In both FIGS. 1*a* and 1*b*, both flexible clasps (5) and belt loops (4) may be provided, thereby giving the user the option of attaching the pocket lining to the belt, or if a suitable belt is not being worn, attaching the pocket via the clasp (5) or both loop (4) and clasp (5) may be used. Also, the flap may be extended over the pocket protector to further secure the pocket in position.

The pocket lining is designed to be inserted into a pocket with optional fastenings (4, 5) to support and keep the pocket lining in place.

FIG. 2 illustrates a right hand trouser pocket lining insert, with an enlarged view of the detail at the pocket lining fold (6). An enlarged view of the details of the belt loop (4) and clasp (5) is shown in FIG. 2*d*.

As can be seen in FIG. 2*b*, a flexible clasp (7) can be inserted into one phase of the front fold. Also, or alternatively a flexible insert (8) can be incorporated into a rolled over seam in the pocket protector fold. Further, a flexible clasp (9) may be inserted into the inside fold of the pocket lining.

FIG. 2*c* illustrates a pocket lining (1) which is identical with that of FIG. 2*a* except that the extension of material to a waist band height for fixing and the belt loop (4) is omitted. This pocket lining can be retained in an existing pocket by a flexible clasp insert (7 or 9) or a flexible insert (8) in the seam at the front flap fold (6).

A pocket lining according to the present invention would be suitable for use by golfers.

A seen in FIG. 3, the pocket lining (1) could consist of two halves, (2, 3), a front half (2) which in the pocket would present itself against the outside face of the garment pocket and a back half (3) which would present itself against the inner inside face of the garment pocket.

The front half (2) has a flap collar (6) which forms the fold along the line of the garment's existing pocket line opening. The flap could in certain materials also have a seam stiffened member (8) and/or clip type fastening (7, 9).

The back half (3) of the pocket extends beyond the line of the opening of the front half to provide a feed tray (10) for ease of access to the pocket. This feed tray (10) has a stiffening membrane (11) within it and such stiffening extends marginally below what would be the line of the opening formed by the front half (2). The object of this is to keep the feed tray (10) presented to the opening and by taking the stiffening membrane (11) beyond the line of the opening prevent the feed tray folding over and preventing access to the pocket.

On the reverse of the back half (3), strips of appropriate material (12) could be added where necessary to provide adhesion to the garment pocket.

The pocket is shaped in such a manner to fit inside a garment's existing pocket. This is retained within the pocket either by the friction of the material on the existing pocket lining, by the addition of some material on the liner to provide such adhesion or in some circumstances by a type of cup of the pocket flaps.

A pocket lining according to the present invention has advantages over known pocket linings in that no sewing is required to position it in an existing pocket. It can be made of a robust material such as leather or a nylon material. It is detachable and therefore can be used in more than one garment and is therefore economic.

The pocket lining is an already made accessory which will immediately fit into a pocket, and requires no sewing skills or other method of repairing a tear to a pocket lining.

The design of the pocket lining allows more robust materials to be utilised as a pocket that is available in standard garments.

The detachable feature of the pocket lining allows it to be utilised as and when required.

The nature of the pocket lining allows it to be utilised in various trousers, jackets, coats, skirts and is therefore economical in protecting a range of clothing when used.

The unique style of fixing the pocket lining to the garment allows it to remain fixed when in use and not easily pulled out as a hand or object enters or leaves the pocket.

What is claimed is:

1. A pocket lining comprising a pouch dimensioned to fit within a pocket constituting an integral part of an article, the pouch being formed of material which is flexible and resistant to abrasion and perforation, characterised in that stiffening means is provided in the vicinity of the pouch opening including a stiffening member for preventing a portion of the pouch-forming material from folding over and preventing access to the pocket.

2. A pocket lining as claimed in claim 1, characterised in that the stiffening means extends beyond the opening of the pocket.

3. A pocket lining as claimed in claim 1, characterised in that stiffening means is incorporated in the seam of the pocket lining.

4. A pocket lining as claimed in claim 1, characterised in that stiffening means is provided in a front flap of the lining.

5. A pocket lining as claimed in claim 1, characterised in that stiffening means is provided in a rear portion of the lining.

6. A pocket lining as claimed in claim 5, characterised in that the stiffening means extends above and below the opening of the pocket.

7. A pocket lining as claimed in claim 1 wherein the article is an article of clothing.

8. A pocket lining as claimed in claim 1 wherein the article is a bag such as a handbag, a golf bag or a sports bag.

9. A pocket lining as claimed in claim 1 comprising attachment means for attachment to a part of the article outside the pocket.

10. A pocket lining as claimed in claim 9 wherein the attachment means is a clasp.

11. A pocket ling as claimed in claim 9 wherein the attachment means comprises a belt loop.

12. A pocket lining as claimed in claim 9 wherein the attachment means comprises a front flap.

13. A pocket lining as claimed in claim 9 wherein the attachment means comprises an extension portion.

14. A pocket lining as claimed in claim 13 wherein the stiffening means is a portion of plastic fitted to one of the front flap and the extension portion.

15. A pocket lining as claimed in claim 9 wherein the extension portion and the front flap are respectively provided on opposing walls of the pocket lining.

* * * * *